US005377831A

United States Patent [19]

Crooks

[11] Patent Number: 5,377,831

[45] Date of Patent: Jan. 3, 1995

[54] CORE OR TUBE PLUG AND ROLL ASSEMBLY THEREWITH

[75] Inventor: David M. Crooks, Paducah, Ky.

[73] Assignee: Westvaco Corporation, New York, N.Y.

[21] Appl. No.: 170,738

[22] Filed: Dec. 21, 1993

[51] Int. Cl.[6] ..... B65D 85/66

[52] U.S. Cl. ..... 206/394; 206/413; 206/414; 242/570

[58] Field of Search ..... 206/394, 413, 414, 415; 242/68.6

[56] References Cited

U.S. PATENT DOCUMENTS

| | | | |
|---|---|---|---|
| 1,861,294 | 5/1932 | Bartlett | 206/415 X |
| 1,919,769 | 7/1933 | Brown et al. | 206/415 X |
| 3,045,944 | 7/1962 | Ciniglio | 242/118.2 |
| 3,371,776 | 3/1968 | Voissem | 206/65 |
| 3,521,833 | 7/1970 | Ridgeway et al. | 242/118.61 |
| 3,547,367 | 12/1971 | Brazeale | 242/68.6 |
| 3,627,220 | 12/1971 | Vogel | 242/68.6 |
| 3,840,194 | 10/1974 | Vetter | 242/68.6 |
| 3,865,326 | 2/1975 | Beaudoin | 242/68.6 |
| 4,015,711 | 4/1977 | Mason | 242/68.6 |
| 4,114,655 | 9/1978 | Bloker | 138/89 |
| 4,249,577 | 2/1981 | Davis | 138/92 |
| 4,460,087 | 7/1984 | DeMarco et al. | 206/415 |
| 4,977,930 | 12/1990 | Munk et al. | 138/89 |

*Primary Examiner*—William I. Price

[57] ABSTRACT

Core or tube plugs protect ends of hollow cores (around which material is wrapped) during transport when a plurality of such wrapped cores is assembled for shipment. Assemblies of a plurality of rolls of such wrapped cores are prepared by inserting a hollow tube through the plurality of wrapped cores and sealing the ends of such cores and tubes with plugs specially designed for that purpose. Each plug has a substantially rotation-symmetrical body with a plurality of axially-sequential segments, one of which at least substantially fills and protects an end of the hollow core and another of which at least substantially fills an end of the hollow tube (which passes through a plurality of hollow cores). One plug at each end of a assembly of wrapped cores secures the assembly together over the tube passing through the wrapped cores.

13 Claims, 3 Drawing Sheets

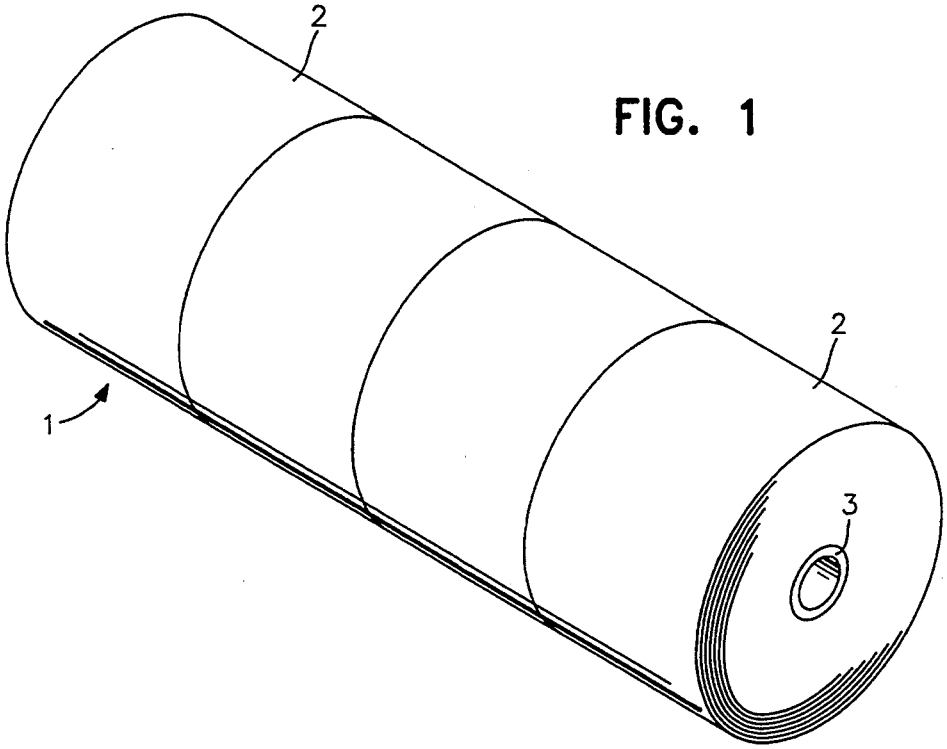
FIG. 1
FIG. 2
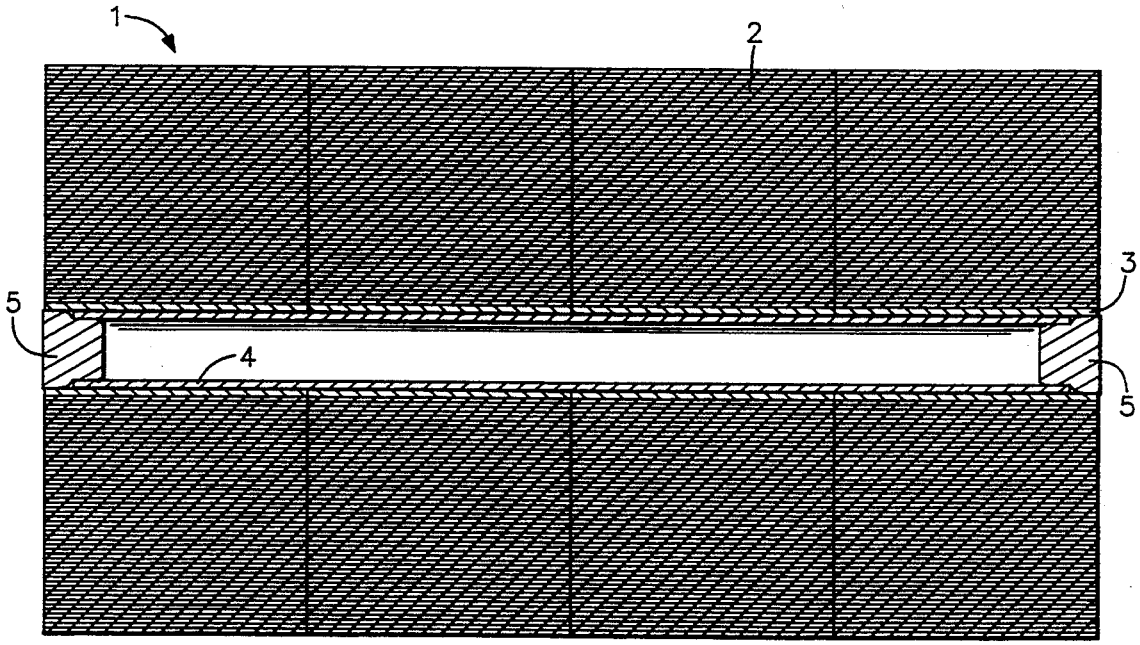

CORE OR TUBE PLUG AND ROLL ASSEMBLY THEREWITH

FIELD OF THE INVENTION

Rolls of sheet material are often provided on cardboard tubes from which such material is subsequently dispensed. Plugs are provided to protect the ends of such tubes from damage and to form a unified assembly of a plurality of rolls.

BACKGROUND

During the manufacturing and conversion processes associated with paper, plastic, fabrics, and various textiles, the finished products are wound into rolls for ease of handling and shipping to various converting operations, as well as to end users and consumers in some instances. The materials are wound on tubes or cores of cardboard or a similar material which have a hollow center portion. During shipping and handling of the rolls the ends of the tubes are plugged with devices, commonly called core plugs, which prevent damage to the ends of the tubes. Any damage to the ends of the tubes could render the roll unusable because it would prevent the insertion of centers or chucks (into the hollow internal bore of the tube) which are used for unwinding the product for use or conversion. These plugs are constructed of various materials, such as wood, plastic, resin bonded fiber, or resin bonded wood products. The materials used for construction are not particularly important for the purposes of this invention. While there is a wide variety of shapes and designs used for this purpose, all of them are of basic cylindrical or conical design in order to fill the end portion of the tubes completely and to prevent the plugs from falling out of the tubes.

Many customers of the manufacturing and converting operations require that rolls of narrow-width products be packaged together for ease of handling. These packages of narrow web rolls present a very unique handling problem due to the inherent instability in their axial direction as a result of extreme ratios of height to width. This instability results in the breakdown of the packages during normal conveyance of the rolls during their production and conversion into a shippable product. The individual rolls are subject to overturning and deformation. They are also very difficult to hold in a unit with adjacent rolls during formation of packages from individual rolls.

Because rolls are wound on a hollow core or tube, the tube becomes the basic building block used to tie adjunctly positioned rolls into a unitized package. Current industry practice consists of positioning like diameter rolls together, axially aligned, and then inserting another hollow tube (with dimensions adequate to reach through the entire package, but not protruding from the end rolls of the package) of smaller diameter through the tube on which the material is wound. The extreme ends of the tubes on which the outer rolls are wound are then plugged to prevent crushing or damage to the ends of the tubes on which the paper is wound. This in turn prevents the inner tube from falling out of the package and thus allows the package to be transported as a unit. This, however, does not prevent the package from breaking down because the rolls are not clamped or held together axially.

PRIOR ART

Munk (U.S. Pat. No. 4,977,930) is directed to what might be regarded as a normal core plug used throughout the industry today. It has a radial flange on its outer edge to prevent over-insertion into a roll tube. The cylindrical shape of the major length of the body of this plug precludes its producing an increasing radial force to hold it in the tube if it were more deeply inserted therein. The plug provides a constant pressure on the inside of the tube as a result of this cylindrical shape. It is protected from over-insertion by the flange, which serves as a stop. The method of manufacture described in this patent is consistent with that of most plugs presently in use within the paper industry. The pressed or molded fiber forms lend themselves to close manufacturing tolerances while also being cost effective to produce.

Bloker (U.S. Pat. No. 4,114,655) and Brazeale (U.S. Pat. No. 3,547,367) are directed to typical tapered core plugs. The conical shape of the plugs allows each plug to engage itself in a roll core or tube by insertion into the tube to a point where the ever-increasing diameter of the plug contacts the inner diameter of the tube. Further insertion into the tube beyond this point of initial contact results in a tighter fit between the two members. While this shape is typical throughout the textile and paper industries, the materials of construction of these items have grown to cover a large realm of materials, including wood, plastic, and molded wood or fiber products. The holes through the centers of these plugs are still in use in portions of the industry today for various reasons, most typically as a means of extracting the plug from the tube or as a center through which some type of axle is inserted to aid in the unwinding of material therefrom.

Vogel (U.S. Pat. No. 3,627,220) attempts to hold adjacently-positioned rolls together both axially and radially for formation of a packaged unit. This item has a significant shortcoming in its design; the plugs must be inserted individually into each roll core, and then the rolls to be packaged adjacent to each other must be moved axially into position. This method of building a package leads to damaged product on the rolls due to the movement along the axis of the core required to position the rolls, tearing the product. This method also requires the use of a fork truck or other means of lifting the rolls to facilitate moving them to positions adjacent to each other for package formation. Because this must be done for every roll in the package, it becomes very labor and material intensive and also lends itself to the shipment of a damaged product. This item best lends itself to manufacture from molded plastics because of the very thin profile required of the center separating flange located radially about the center of the plug. This design has not been widely accepted on the manufacturing level but has found limited use at converting operations which produce packages of very small sizes and which are capable of being handled by hand methods, such as adding machine tape, etc.

A variety of other alternative core plugs are found, e.g., in Ciniglio (U.S. Pat. No. 3,045,944), Voissem (U.S. Pat. No. 3,371,776), Ridgeway (U.S. Pat. No. 3,521,833), Vetter (U.S. Pat. No. 3,840,194), Davis (U.S. Pat. No. 4,249,577) and DeMarco (U.S. Pat. No. 4,460,087), but none of the foregoing offer or suggest the combination of features which characterizes the subject invention.

SUMMARY OF THE INVENTION

An object of this invention is to produce a more stable package by building on the basic principles of package construction which are presently in existence throughout associated industries.

A further object is to use a hollow inner tube to unitize a package of rolls of material wrapped around individual hollow cores through a tube plug design that locks the inner unitizing tube to the outer hollow roll cores on which the material is wound. Another object is to provide a design which is adaptable to various types of tube plugs in use at the current time, including tapered plugs, hollow plugs, cylindrical plugs, and flanged plugs.

Still further objects are apparent from the description which follows.

There are several distinct aspects of this invention, which is primarily based on a novel core plug capable of protecting an end of a hollow core suitable for supporting material wrapped around it.

One aspect of the invention is a core plug comprising a substantially rotation-symmetrical body having the following axially-sequential segments:

a) a section which is either conical in shape so that it will reach a point of maximum insertion and holding strength prior to being fully inserted into the core, or substantially cylindrical in shape with a radial thickening or flange at its outermost edge and of sufficient size to prevent over-insertion into the core;

b) a conical section which assists in alignment of the hollow core and precludes over-insertion into the hollow tube;

c) a conical section suitable for insertion into the hollow tube; and d) a conical starter section which assists in alignment of the plug in the hollow tube.

Another and optional aspect of the invention relates to such a plug having at least one axially-oriented bar, key or ridge means along each of sections (a) and (c) to prevent the plug from twisting between the hollow core and the hollow tube.

A further aspect of the invention relates to such a plug having a conical transition section between section (a) and section (b).

A still further aspect of the invention provides a plurality of rolls of material, the material on each roll being wrapped around a hollow core of substantially the same inner diameter, and each roll of which is in touching proximity to each adjacent roll, in combination with a) a hollow tube which passes through the hollow core of and thus aligns the plurality of rolls, the hollow tube being shorter than the combined lengths of said hollow cores, and b) plugs at each end of the hollow tube, each plug having a section which completely fills an end of the hollow core when it is conical and snugly fits within an end of the hollow core when it is cylindrical, and having a section which at least substantially fills an end of the hollow tube.

The plugs are thus capable of securing and aligning opposite ends of a hollow tube with the hollow core, particularly in forming an assembly of a plurality of rolls having hollow cores and mounted on a hollow tube substantially passing through such cores.

The plug is constructed to align and protect opposite ends of both the assembled hollow core and the inner tube supporting both the assembled core and the rolls of material thereon.

BRIEF DESCRIPTION OF THE DRAWINGS

FIG. 1 is an isometric view of an assembly of rolls of material having a central core.

FIG. 2 is a cross section of such assembly with an inner (unitizing) tube and plugs at each end.

DETAILS

Figure 3:
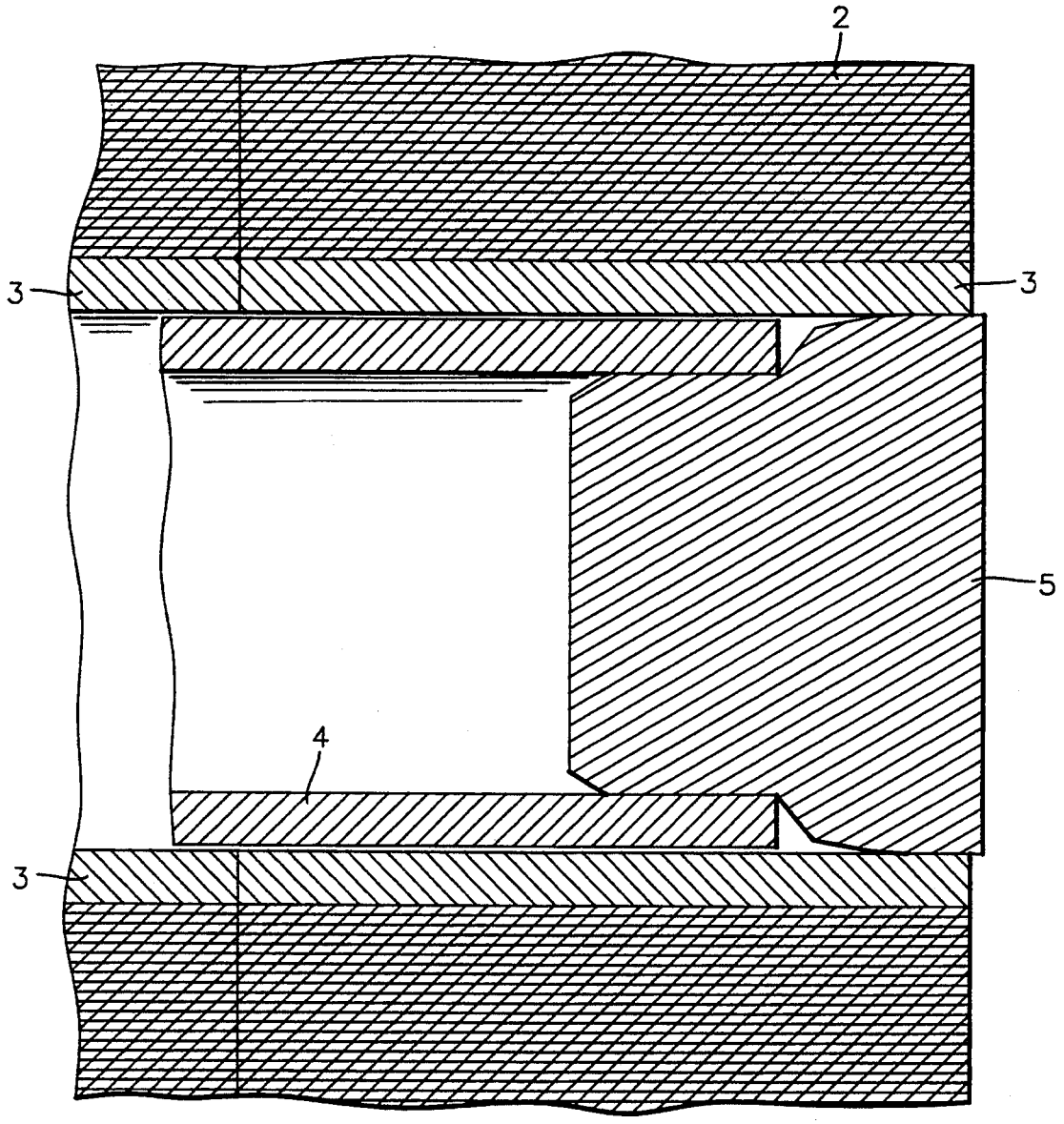
FIG. 3 is an enlarged cross-sectional view of the plug and its relationship to the roll core and the inner (unitizing) tube.

An assembly 1 of rolls 2 of material wrapped around hollow cores 3 are shown in FIGS. 1 and 2, the latter being in cross section and additionally showing a unitizing inner tube 4 and a holding plug 5 at each end.

FIG. 3 provides an enlarged cross section to illustrate how each plug provides a unitizing function by protecting the end of the hollow core 3 and securing the hollow core to the hollow tube 4 (within a plurality of rolls 2).

Figure 4:
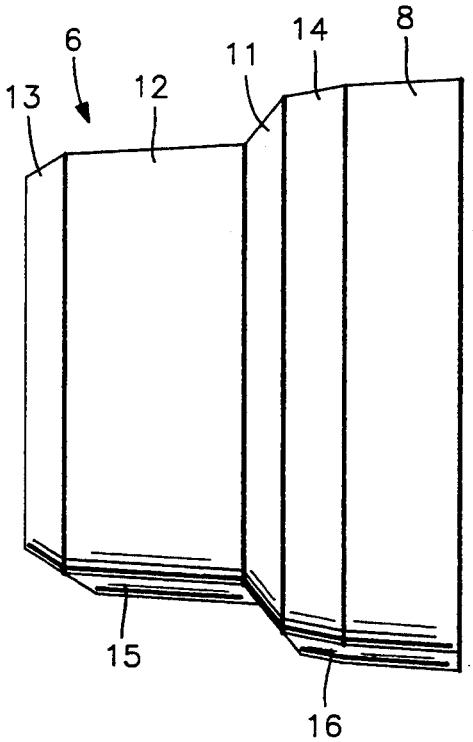
FIG. 4 is a side plan view of one embodiment of the plug.
Figure 5:
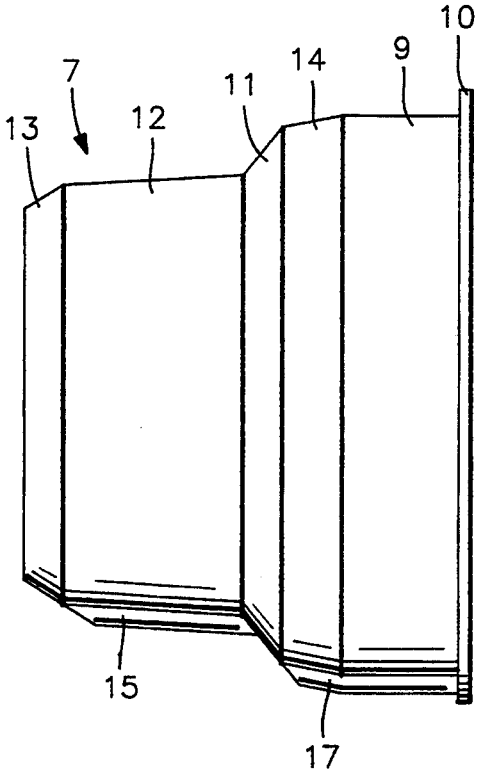
FIG. 5 is a side plan view of another embodiment of the plug.
Figure 6:
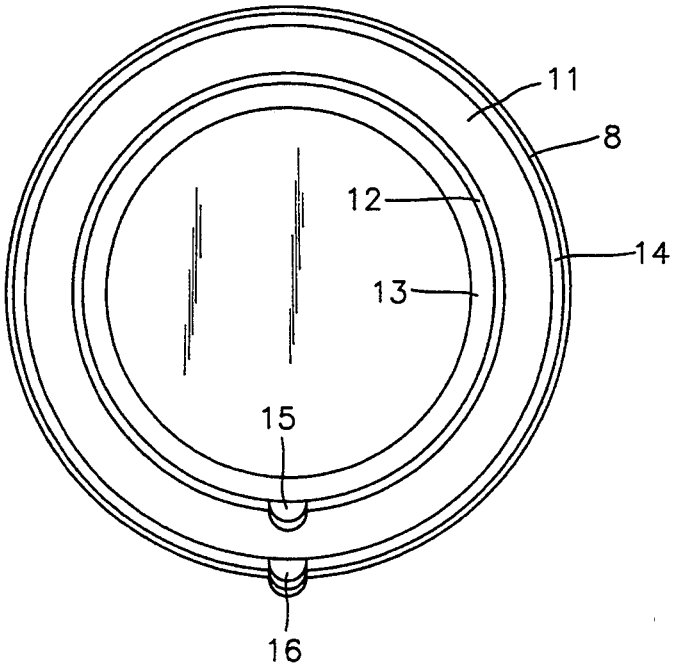
FIG. 6 is a front plan view of the plug of FIG. 4.

Two distinct embodiments, 6 and 7, are shown in FIGS. 4 and 5, respectively. With reference to FIG. 4, the major plug section 8 is preferably conical in shape and is that portion of the plug that is placed in an end of the hollow core 3 on which material is wound. It prevents crushing or damage to the end of the core 3 of the outer rolls of material in each assembly of rolls. Section 8 is conical in shape so that it will reach a point of maximum insertion and holding strength prior to being fully inserted in core 3. This section is optionally produced as a cylindrical section 9 (shown in FIG. 5) with a radial thickening or flange 10 at its outermost end to prevent over-insertion. The purpose of the major plug section 8 or 9 is to prevent core damage and to clamp the outermost ends of the package together in order to produce a package which is resistant to both axial and radial breakdown during handling.

The plugs have a tube stop 11, which is normally a conical transition from the major plug section 8 or 9 to the inner tube plug 12. The transition section 11 is preferably of extreme conical shape to provide for the changes in diameter of the plug 6 or 7. It provides a means of preventing over-insertion of the plug into the inner tube 4 and also provides for alignment of the plug in the hollow core 3.

The tube plug section 12 is conical in shape so that deeper insertion into the inner tube produces greater radial loading between the plug 6 or 7 and the inner wall of tube 4, which in turn produces greater axial holding strength.

Each plug has a starter section 13, which is of extreme conical shape and serves to provide alignment of the plug into the inner tube 4.

The plugs of this invention preferably have a major plug transition section 14. This section promotes initial alignment of the plug within an end of the hollow core. Its conical shape allows it to be inserted into the hollow core even when the latter has slight defects on its internal wall. Such defects can be the result of cutting the core to its proper length (e.g., burrs, frayed ends, or torn liner) or, in some cases, manufacturing tolerances which allow large variations in the internal diameter of such cores.

The plugs preferably and advantageously have at least one (e.g., two to four) axially-oriented bar, key or ridge means 15 (along section 12) and 16 (along sections 8 and 14) or 17 (along sections 9 and 14). The bar, key or ridge means prevents the plug from twisting between the outer core 3 and the inner tube 4, thus helping to ensure that a bond between the three objects (the core, the tube and the plug) will not be broken. This bond is effected by providing an area of extreme compression, which runs axially along the extreme ends of the core and tube.

The invention and its advantages will be readily understood from the preceding description. Various changes may be made in the form, construction and materials without departing from the spirit or scope of the invention or sacrificing its material advantages. For example, the core plugs are, optionally, either solid or hollow; they are composed of any suitable material, e.g. wood, plastic, metal or composite; and they are made by any convenient method known in the art, e.g. by molding. The forms described herein and illustrated in the drawings are merely those of preferred embodiments.

What is claimed is:

1. A plug capable of protecting an end of a hollow core suitable for supporting material wrapped thereover and further capable of securing and aligning each of opposite ends of a hollow tube within the hollow core, the plug comprising a substantially rotation-symmetrical body having the following axially-sequential segments:

a) a section which is shaped for insertion into the hollow core;

b) a conical section which assists in alignment of the hollow core and precludes over-insertion into the hollow tube;

c) a conical section suitable for insertion into the hollow tube; and d) a conical starter section which assists in alignment of the plug in the hollow tube.

2. A plug of claim 1 having axially-oriented bar, key or ridge means along each of sections (a) and (c) to prevent the plug from twisting between the hollow core and the hollow tube.

3. A plug of claim 1 having a conical transition section between section (a) and section (b).

4. A plug of claim 1 wherein section (a) is conical in shape so that it reaches a point of maximum insertion and holding strength prior to be fully inserted into the core.

5. A plug of claim 1 wherein section (a) is substantially cylindrical in shape with a flange at its outer most edge and a sufficient size to prevent over-insertion into the core.

6. A combination of a plurality of rolls of material, the material on each roll being wrapped around a hollow core of substantially the same inner diameter, and each roll of which is in touching proximity to each adjacent roll;

a hollow tube which passes through the hollow core of and thus aligns the plurality of rolls, the hollow tube being shorter than the combined lengths of said hollow cores; and a plug of claim 5 at each end of the hollow tube; wherein section (a) of the plug snugly fits within the end of the hollow core; and section (c) of the plug at least substantially fills the end of the hollow tube.

7. A plug of claim 1 wherein the smaller diameter of each conical section is less than that of each preceding conical section.

8. A plug of claim 7 wherein the slopes of conical sections (b) and (d) are greater than the slopes of each of the other conical sections.

9. A combination of a plurality of rolls of material, the material on each roll being wrapped around a hollow core of substantially the same inner diameter, and each roll of which is in touching proximity to each adjacent roll;

a hollow tube which passes through the hollow core of and thus aligns the plurality of rolls, the hollow tube being shorter than the combined lengths of said hollow cores; and a plug of claim 4 at each end of the hollow tube; wherein section (a) of the plug completely fills the end of the hollow core; and section (c) of the plug at least substantially fills the end of the hollow tube.

10. An assembly of a plurality of rolls, a hollow tube and a pair of plugs of claim 1, each roll comprising material wrapped around a hollow core, each core of which has substantially the same inner diameter, the hollow tube being within each hollow core, having an outer diameter which is at most substantially the same as the inner diameter of the hollow core, and having a length which approximates, but is less than, the combined lengths of the hollow cores, and the plugs being within the ends of the hollow tube and providing means for securing the assembly together.

11. A combination of claim 10 wherein section (c) snugly fits within the end of the hollow tube.

12. A combination of claim 10 wherein section (a) is a conical section.

13. A combination of claim 10 wherein section (a) is a cylindrical section with a flange at its outermost edge.

* * * * *